United States Patent [19]

Schmitz et al.

[11] 4,298,107

[45] Nov. 3, 1981

[54] BRAKE SYSTEM FOR A TEXTILE MACHINE

[75] Inventors: Gerd Schmitz, Sulz/Attikon; Otto Hintsch, Wallisellen, both of Switzerland

[73] Assignee: Sulzer Brothers Limited, Winterthur, Switzerland

[21] Appl. No.: 99,476

[22] Filed: Dec. 3, 1979

[30] Foreign Application Priority Data

Dec. 6, 1978 [CH] Switzerland ..... 12476/78

[51] Int. Cl.[3] ..... F16D 67/02; F16D 71/00; F16D 65/36

[52] U.S. Cl. ..... 192/12 D; 192/12 C; 192/144

[58] Field of Search ..... 192/12 R, 12 C, 12 D, 192/17 A, 17 C, 144; 303/20

[56] References Cited

U.S. PATENT DOCUMENTS

| | | | |
|---|---|---|---|
| 3,371,760 | 3/1968 | Willsea | 192/12 D X |
| 3,572,484 | 3/1971 | Richins | 192/144 |
| 3,910,644 | 10/1975 | Packer | 303/20 X |
| 4,161,649 | 7/1979 | Klos et al. | 192/144 |

FOREIGN PATENT DOCUMENTS 1142964 2/1969 United Kingdom .

*Primary Examiner*—Allan D. Herrmann
*Attorney, Agent, or Firm*—Kenyon & Kenyon

[57] ABSTRACT

The braking system for the textile machine is provided with a multiplicity of brake elements which are individually controlled via a common control means. Each brake has a different braking characteristic from the other so that the machine components or attachments can be separately braked. The braking system can be electronically controlled so as to not only brake but also to permit adjustment of the brakes.

26 Claims, 13 Drawing Figures

Fig.6c
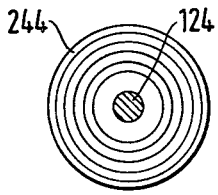
Fig.6
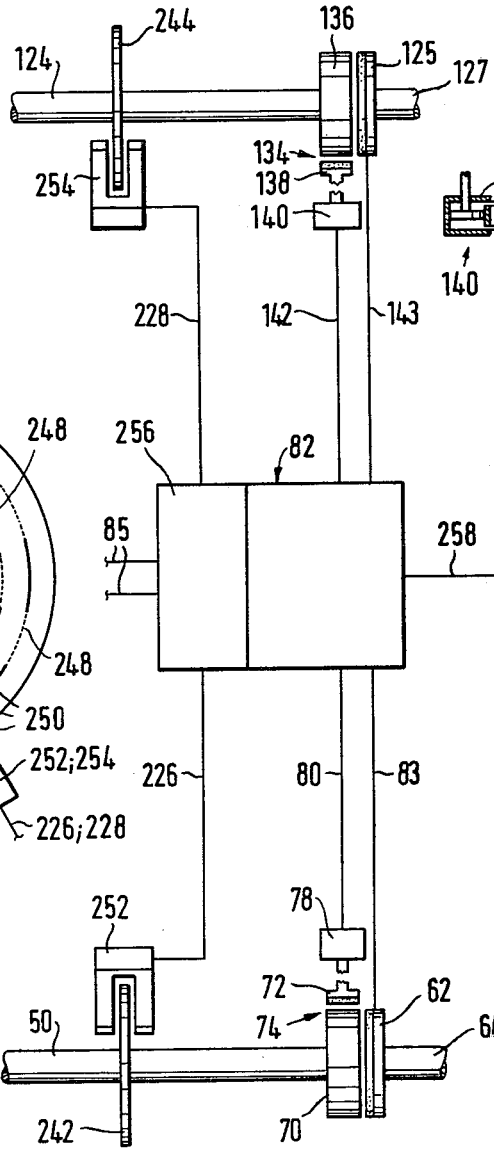
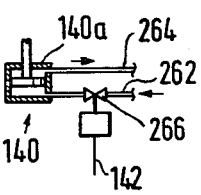
Fig.6b
Fig. 6a
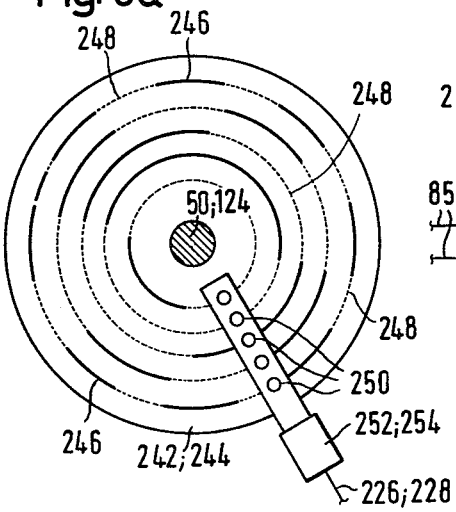
Fig.6d
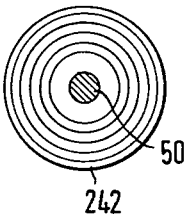

BRAKE SYSTEM FOR A TEXTILE MACHINE

This invention relates to a brake system for a textile machine. More particularly, this invention relates to a brake system for a textile machine producing textile articles having a large superficial area.

As is known, the operation of a textile machine such as a weaving or knitting machine in which textile articles having a large superficial area are produced may be interrupted by various disturbances which require a very rapid interruption of operation or a rapid braking of the machine in order to obviate or, at least, reduce damage to the machine or the article being produced and to permit clearing of the fault.

For instance, the disturbances which occur in weaving machines are of two main categories—weaving and mechanical. Weaving disturbances particularly include all warp and weft breakages. The main mechanical disturbances include, for instance, in the case of projectile weaving machines, disturbances in projectile operation, disturbances in the projectile mechanisms on the picking and catching sides and disturbances of various drive elements such as the cam-follower levers.

As is known, the warp in a textile machine is generally monitored by electric warp yarn detectors which stop the machine in the event of a warp yarn breakage. The weft can also be monitored, e.g. by an electronic weft detector which stops the machine if a weft is absent or if a weft yarn breaks. In the case, for instance, of a projectile machine, the weft detector must continue to monitor picking until the projectile has come to a standstill in the catching mechanism, since the main shaft angle at which a breakage or any other disturbance of a weft yarn occurs is very important. For instance, if a projectile machine fails to be braked at a particular angular position of the main shaft, the weft yarn cannot readily and rapidly and correctly be reinserted into the recovery mechanism and yarn feeder normally present in such machines on the picking side. Auxiliary means must be provided on the picking side to insert the weft yarn or else an idle pick must be made with subsequent correction of shedding, picking sequence and cloth take-up.

Interlocks or the like associated with a shedding mechanism and a weft-hunting mechanism prevent a projectile machine from starting unless the shafts of the attachments and the like are in the correct angular position for their operation. These interlocks usually act by way of an appropriate linkage on one or more detector shafts directly. That is, upon operation of an interlock, the associated detector shaft rotates and, for instance, the locking pin of a brake device is disengaged from a locking member or the brake device is operated electrically. The machine is braked immediately with the motor stopping, the drive clutch releasing and the brake being applied simultaneously.

In the case, for instance, of knitting machines, very rapid braking is required in response to disturbances, such as yarn breakages and mis-operations of the patterning attachment, to ensure that a fault which has already occurred in the knitted fabric can be kept within very narrow limits.

Conventionally, a single brake on the main shaft on the main drive side has been responsible for all braking operations in response to all disturbances, whether on the weaving or knitting or mechanical side. However, the disadvantages of this system are that severe stressing and deformation of the shafts occurs when the machine is braked rapidly and that considerable braking power is concentrated in a single brake. Further, a consideration which applies particularly to machines of considerable width, i.e. machines having a very long main shaft, is that the parts and units which are driven by the main drive and which are relatively far away from the brake may experience considerable differences as regards the start of braking and the braking distance. As a result of the considerable braking power and of the reduced torsional resistance of long shafts, there is the further risk that braking may not become operative by the time the shaft concerned reaches a predetermined angular position. As a result, the possibility exists that the elements which are secured to the shafts may oscillate and shift. The shafts, gearing and other items of the long transmission could, of course, be of more substantial dimensions, but the machine would then cost considerably more.

Accordingly, it is an object of the invention to distribute the braking power of a brake system for a textile machine among the various machine parts and attachments driven by a main drive.

It is another object of the invention to provide a braking system for a textile machine wherein parts remote from the main drive can be braked rapidly and accurately at required predetermined angular positions of a main drive shaft.

It is another object of the invention to be able to brake a textile machine and the various components thereof to a rapid and reliable stop in response to a disturbance or fault.

Briefly, the invention provides a textile machine having a plurality of individual operating components and a main drive for actuating and driving each component with a brake system which includes at least two brake elements and a common control means for actuating the brake elements. In addition, each brake element is selectively connected to a respective component of the machine to effect braking thereof and each has a different braking characteristic relative to the other brake element. For example, the brake elements may differ in the start-to-brake time and/or braking distance.

Advantageously, the angular positions of the shafts of the various machine components and the like can be detected or monitored in operation and compared with one another or with predetermined set-value angular positions. This feature enables the start of braking and the braking distance of the brake elements or machine components to be adapted optimally to the specific requirements of such machine components.

According to another advantageous feature of the invention, the brake elements can have their operative state monitored continuously. For instance, actual braking distances can be compared with preprogrammed set-values for braking distances. If the set values are not observed for any reason, such as wear of the brake elements, the same can be adjusted automatically.

These and other objects and advantages of the invention will become more apparent from the following detailed description and appended claims taken in conjunction with the accompanying drawings in which:

Figure 4:
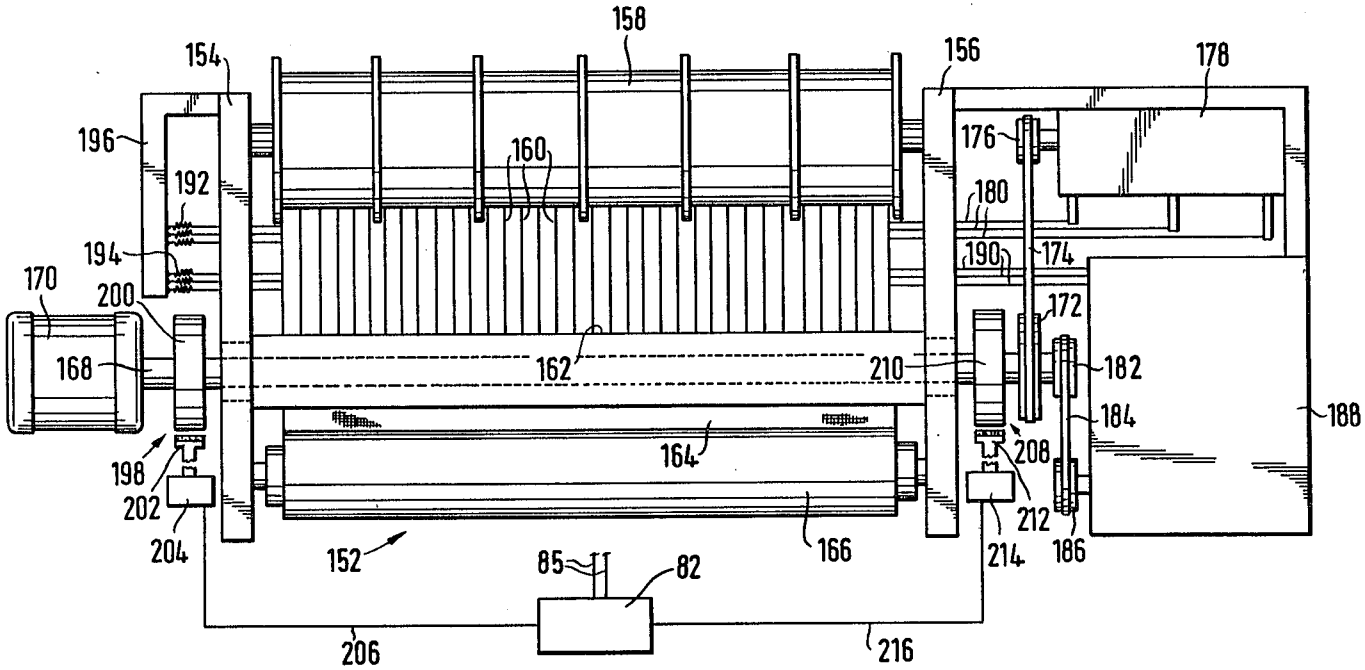
Figure 5A:
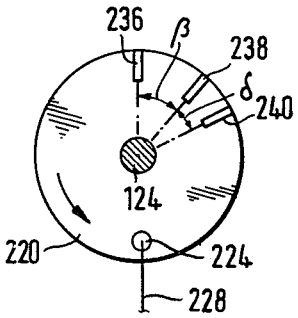
Figure 5:
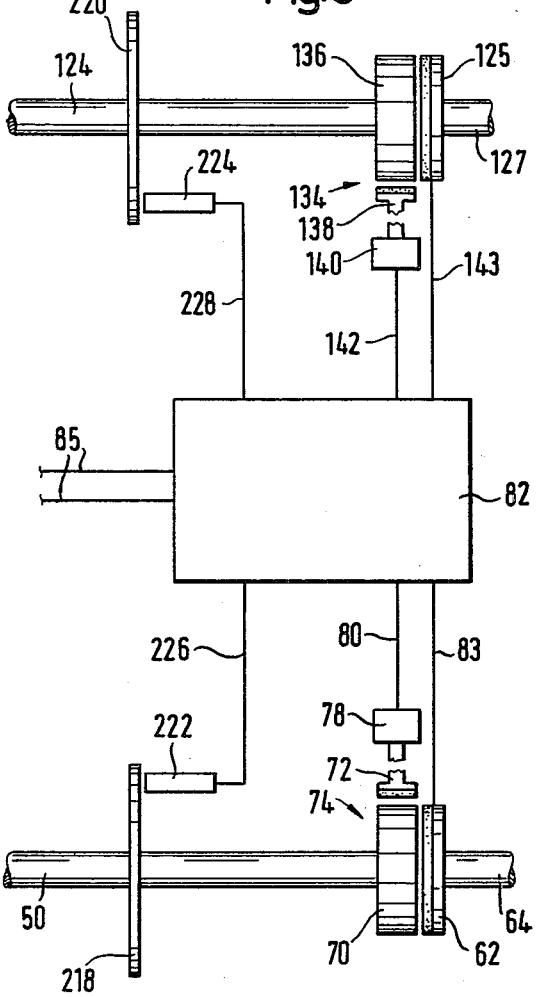
Figure 5B:
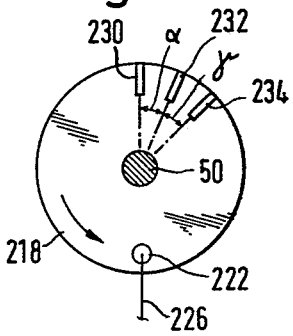
Figure 7:
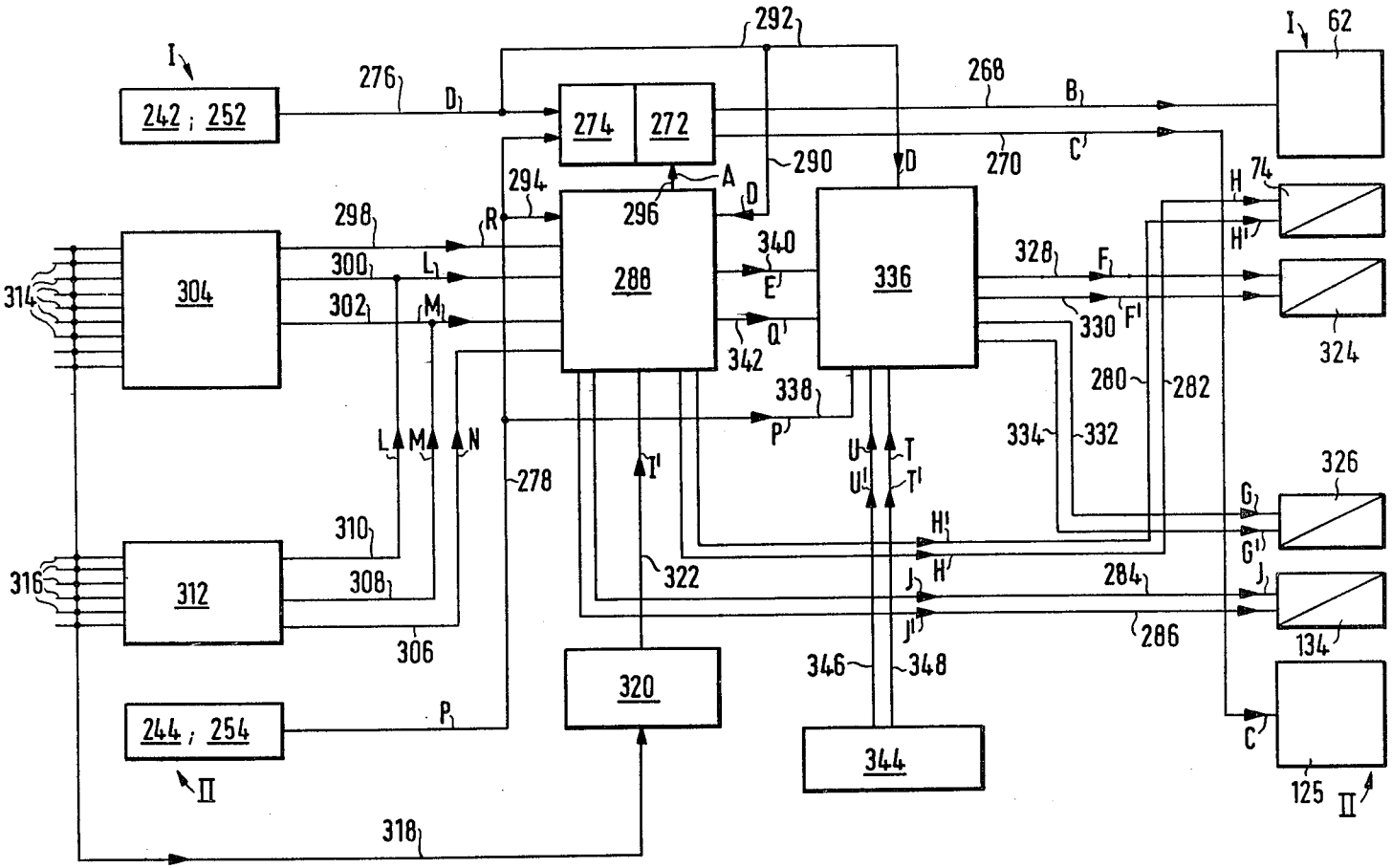

FIG. 4 diagrammatically illustrates a front elevational view of a brake system for a knitting machine in accordance with the invention;

FIG. 5 illustrates an embodiment of a brake system according to the invention with clutches associated with brake elements and with angle pick-offs disposed on respective shafts for actuating the clutches or brake systems;

FIG. 5*a* illustrates a view of one angle pick-off shown in FIG. 5;

FIG. 5*b* illustrates a view of a second angle pick-off illustrated in FIG. 5;

FIG. 6 illustrates a brake system having angle encoders disposed on various shafts to provide continuous monitoring of the angular positions for actuating the clutches or brake elements at any required predetermined angular position;

FIG. 6*a* illustrates a view of an angle encoder of FIG. 6;

FIG. 6*b* illustrates a schematic view of a control element for controlling the braking pressure in a brake in accordance with the invention;

FIG. 6*c* illustrates an end view of an encoder utilized in accordance with the invention;

FIG. 6*d* illustrates a view of a further encoder utilized in accordance with the invention; and FIG. 7 diagrammatically illustrates a view of a brake system for a weaving machine in which clutches and brake elements are monitored and controlled electronically with the use of preprogrammed variable braking distances and angular positions for the start of braking and in which the operative state of the brake elements is monitored and adjusted or controlled automatically.

Figure 1:
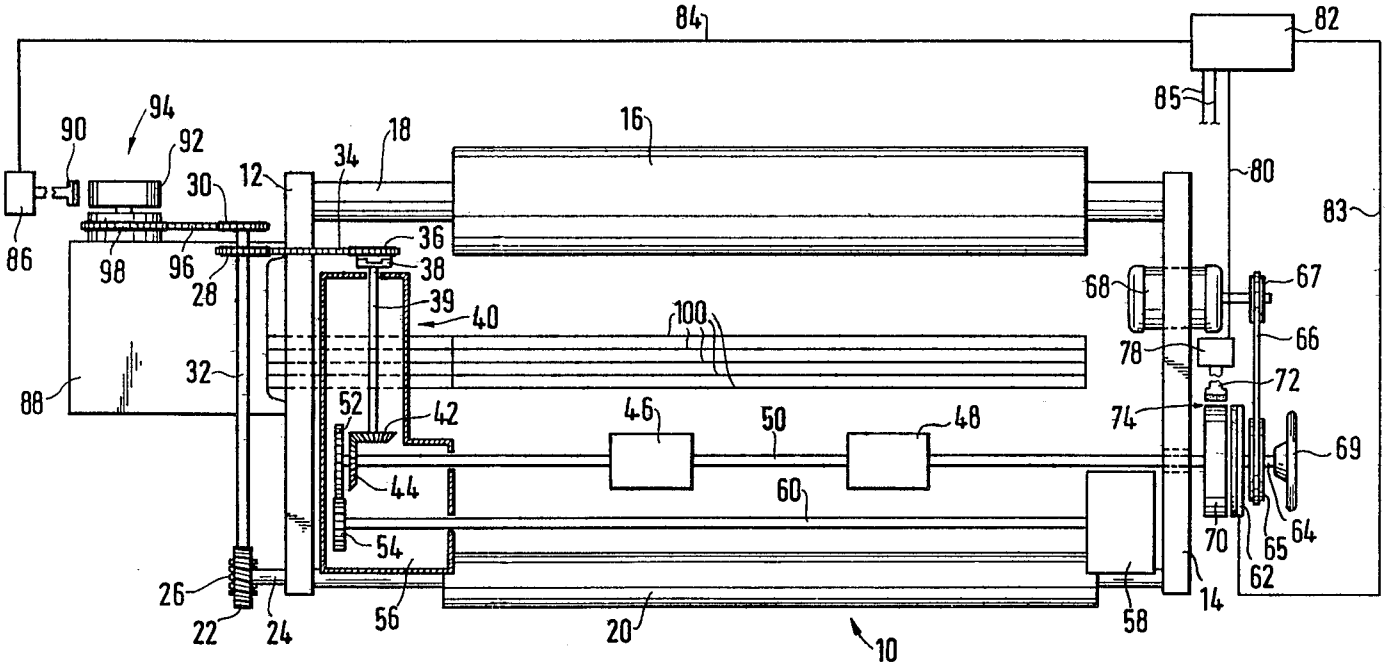
FIG. 1 illustrates a diagrammatic plan view of a brake system for a weft projectile type weaving machine in accordance with the invention.

Referring to FIG. 1, a weaving machine 10 has various components which include a warp beam 16 disposed between lateral uprights 12, 14, a tensioning beam 18 and an indexing beam 20. The indexing beam 20 is driven off a main drive 68 via a main shaft 50. As shown, the main shaft 50 is connected to sley drives 46, 48 and has a bevel gear 44 at one end which meshes with a bevel gear 42 of a cross-shaft 39 of a weft hunter 40. The cross-shaft 39 has a clutch 38 which engages with a sprocket 36 about which a chain 34 engages in driven relation. The chain 34, in turn, engages a sprocket 28 on an indexing shaft 32 in order to drive the shaft 32. This shaft 32 carries a worm 26 at one end which meshes with another worm 22 on a shaft 24 of the indexing beam 20 so as to drive the indexing beam 20. In addition, the indexing shaft 32 has a sprocket 30 at the opposite end for driving a shedding device 88 via a chain 96 and sprocket 98 of the shedding device 88.

The main shaft 50 also drives a picker 56 and carries a gear 52 for meshing with a gear 54 on a sub-shaft 60. The sub-shaft 60, in turn, connects the picker 56 to a catcher 58 for driving the same.

The main shaft 50 is connected to the main drive 68 via a clutch 62, a clutch shaft 64, a pulley 65, a belt 66 and a pulley 67. As indicated, the clutch shaft 64 has a handwheel 69 thereon for manual operation.

A brake system includes a number of brake elements each of which is selectively connected to a respective component of the weaving machine to effect braking thereof. As shown, the brake system includes a brake 74 (shown diagrammatically) having a brake drum 70 on the main shaft 50 and a brake element 72 mounted for cooperation with the brake drum 70. The brake 74 is operated by a final control element 78 which is connected via a signal line 80 to a central control means 82. As indicated, the clutch 62 is also connected via a signal line 83 to the control means 82.

The brake system also includes a brake 94 (shown diagrammatically) for the shedding device 88. This brake 94 includes a brake drum 92 on the shedding device 88 and a brake element 90 for braking the drum 92. The brake element 90 is connected to and actuated by a final control element 86 which, in turn, is connected via a signal line 84 to the common control means 82.

The final control element 78, 86 can be, for example, pneumatic or hydraulic actuating cylinders, electromagnets, tension springs or the like. Further, the control means 88 communicates via a multiplicity of signal lines 85 with various detecting means.

As illustrated, the shedding device 88 operates a multiplicity of healds 100 of the weaving machine.

The brake system described operates as follows:

A pulse supplied, e.g., by one of the electronic or mechanical detecting means of the machine via one of the signal lines 85 to the control means 82 acts via signal line 83 to release the clutch 62 and by way of the two signal lines 80, 84 to actuate the final control elements 78, 86 with a corresponding actuation of the brakes 74, 94. The result is simultaneous braking of the main shaft 50 and the shedding device 88. The clutch 38 associated with the weft hunter 40 can then be disengaged and the cross-shaft 39 can be turned back, e.g. by one weft, for the picker to be corrected correspondingly.

Figure 2:
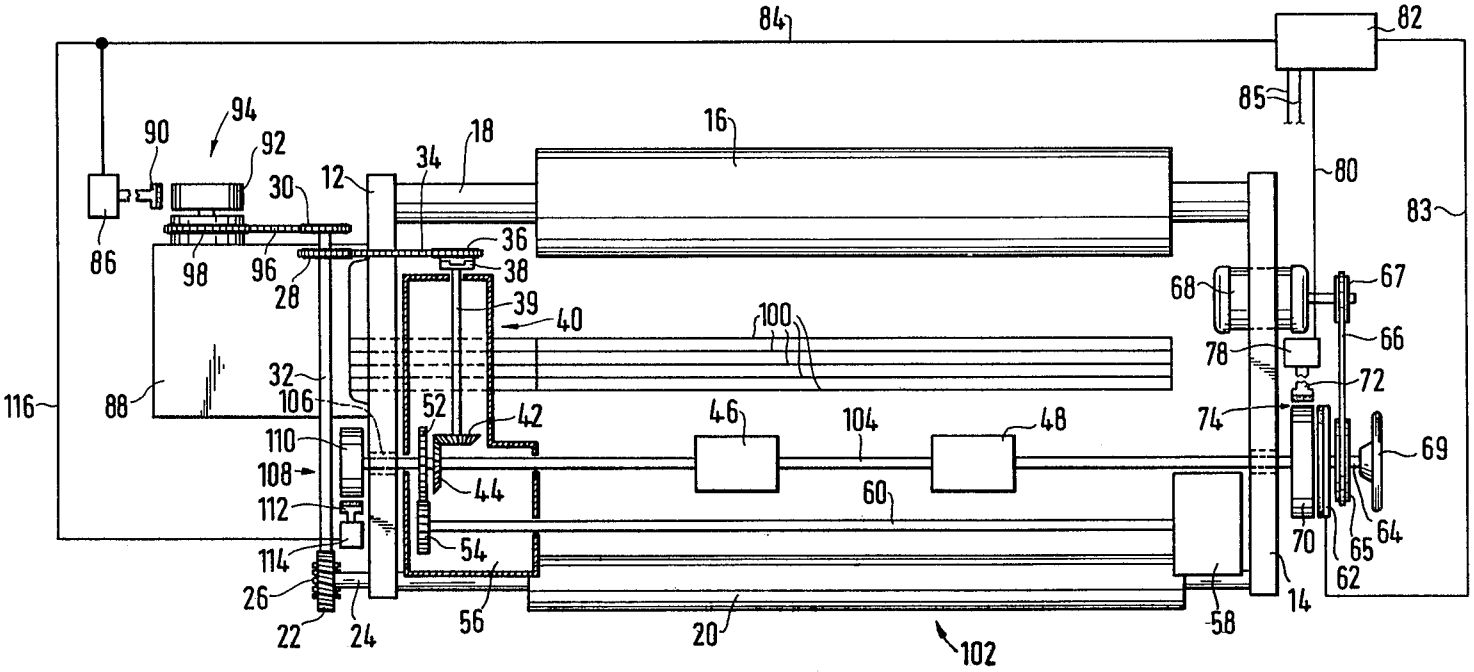
FIG. 2 illustrates a diagrammatic plan view of a modified brake system for the weaving machine of FIG. 1.

Referring to FIG. 2, wherein like reference characters indicate like parts as above, the weaving machine 62 may also be provided with an additional brake 108 comprising a brake drum 110 and a brake element 112 on a lengthened main shaft 104. The main shaft 104 extends through the machine frame 12 and has an additional mounting in a bearing 106. The brake 108 is actuated by a final control element 114 connected by a signal line 116 to the signal line 84.

The operation of the brake system just described corresponds to the brake system described with reference to FIG. 1; however, the additional brake 108 ensures better distribution of the total braking effect, particularly if the main shaft 104 is very long.

Figure 3:
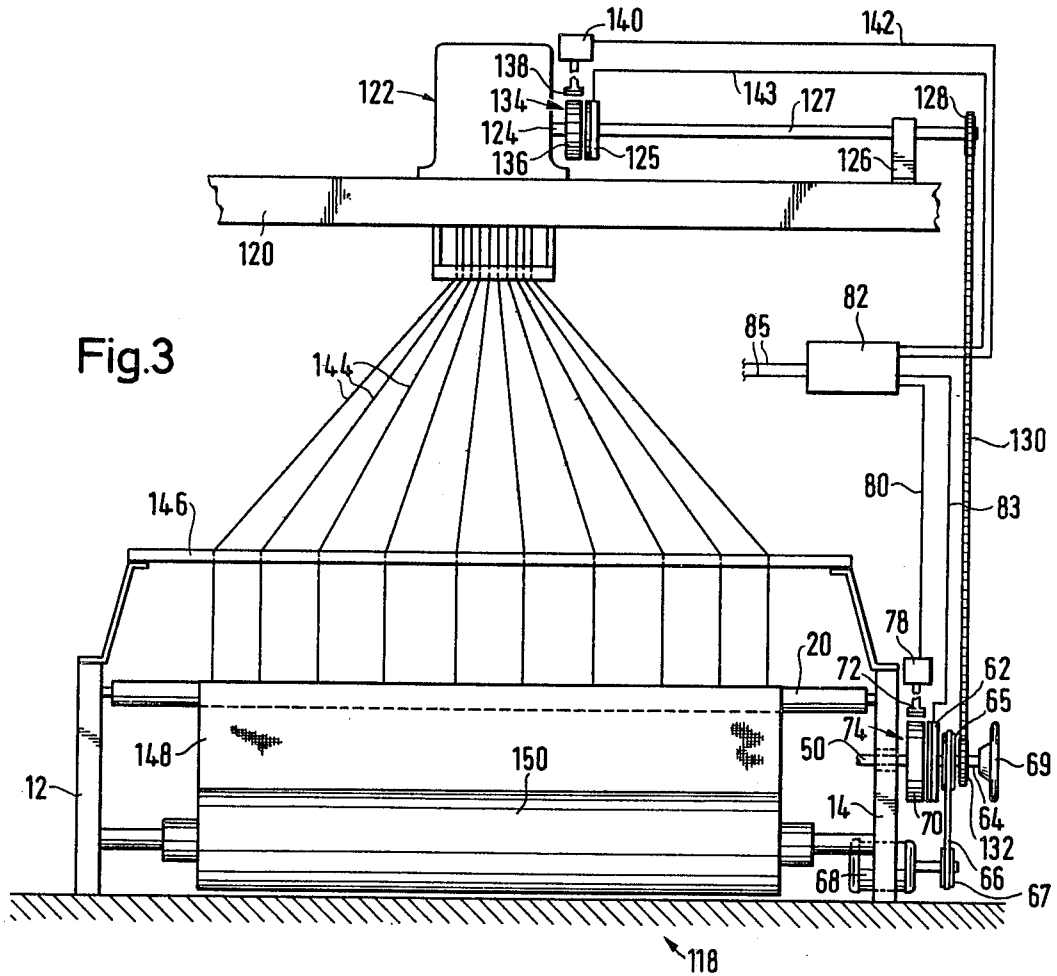
FIG. 3 illustrates a diagrammatic view of a brake system for a weft projectile-type weaving machine employing a Jacquard attachment in accordance with the invention.

Referring to FIG. 3, wherein like reference characters indicate like parts as above, the weaving machine 118 may also have an overhead beam 120 on which a jacquard attachment 122 is mounted with a drive shaft 124 connected via a clutch 125, a clutch shaft 127 mounted in a bearing pedestal 126 on the beam 120, a sprocket 128, chain 130 and a sprocket 132 to the clutch shaft 64. This construction also includes a brake 134 comprising a brake drum 136 and a brake element 138 on the drive shaft 124. The brake 134 is actuated by a final control element 140 connected by a signal line 142 to the control means 82. The clutch 125 is also connected by a signal line 143 to the control means 82. As shown, harness cords 144 extend in known manner from the jacquard attachment 122 by way of a harness board 146 and the finished article is taken upon a cloth beam 150.

The brake system just described operates similarly to the brake systems described previously; however, the additional clutch 125 serves to release the jacquard attachment 122 from the main drive 68. Consequently, the jacquard attachment 122 can be braked over a greater braking distance, i.e. more gently, than the actual weaving machine.

Referring to FIG. 4, the knitting machine 152 has a front warp beam 158 which is disposed between side machine uprights 154, 156 and from which warp yarns 160 are paid off past a beating-up edge 162. A finished article 164 is taken up on a cloth beam 166. As shown, a main drive 170 drives a main shaft 168 which, in turn, drives a fine patterning (attachment 178) via a pulley 172, belt 174 and pulley 176. A plurality of fine guide bars 180 for the ground yarns extend from the attachment 178 transversely of the warp yarns 160. Also, by way of a pulley 182, belt 184 and pulley 186, the main shaft 168 drives a main patterning mechanism 188 from which main guide bars 190 for pattern yarns and ground yarns extend transversely of the warp yarn 160. The two sets of guide bars 180, 190 are secured by means of springs 192, 194 respectively to a holder 196.

The main shaft 168 has a brake 198 comprising a brake drum 200 and a brake element 202 actuated by a final control element 204 connected by a signal line 206 to a control means 32. At the other end, the main shaft 168 has a second brake 208 comprising a brake drum 210 and a brake element 212. The brake 208 is actuated by a final control element 214 connected by a signal line 216 to the control means 82.

The construction and operation of the knitting machine 152 are assumed to be known and are described, for instance, in Swiss Patent Specification 496,128. The provision of the second brake 208 on the main shaft 168 helps to provide a much more uniform braking effect, particularly if the machine is of considerable width.

If detecting means for the angular position of the respective shaft are used in association with the shafts 50, 124 of the weaving machine 118 and jacquard attachment 122 respectively (FIG. 3), the shafts 50, 124 can be braked with different braking distances at various accurately predetermined angular positions. FIG. 5 is a view in diagrammatic form of a simple example of such a brake system. In this case, the detecting means functions as angle pick-offs and take the form of rotating discs 218, 220 which are disposed on the shafts 50, 124 and which have detectors 222, 224 connected by signal lines 226, 228 to the control means 82.

The detectors 222, 224 can, in known manner, be e.g. non-contacting magnetic switches, which are energized by bar-like magnetic pulse transmitters (or pick-offs) 230, 232, 234 and 236, 238, 240 respectively arranged three on each disc 218, 220 and adapted to be adjusted peripherally. The transmitters are disposed at angular distances of $\alpha$, $\gamma$ and $\beta$, $\delta$ respectively from one another, in such manner that, assuming the direction of rotation indicated, whichever transmitter 230, 236 comes first acts via the signal line 226, 228 respectively to release the control means 82 and, via the signal line 83, 143 to release the clutch 62, 125, whereas the subsequent transmitters 232, 238 and 234, 240 respectively act via the control means 82 and the signal lines 80, 142 respectively to operate the brakes 74, 134.

The brake system just described operates as follows:

If, for instance, the braking distance $\beta+\delta$ of drive shaft 124 of the jacquard attachment is 60° and the braking distance $\alpha+\gamma$ of the main shaft 50 is 30°, the pulse transmitters 230, 232, 234 and 236, 238, 240 respectively are adjusted so that, e.g. the angles $\beta$, $\delta$ are greater than the angles $\alpha$, $\gamma$, i.e. so that the brake 134 acts more gently than the brake 74. When the controlling means 82 receives a corresponding braking signal via one of the lines 85, the two detectors 222, 224 are activated. When the transmitters 230, 236 coincide with the corresponding detectors 222, 224 (assuming that the shafts are running synchronously), the clutches 62, 125 are released by way of the lines 83, 143. The shafts 50, 124 respectively move idly through the angular distance $\alpha$, $\beta$ respectively. When the transmitters 232, 238 coincide with the detectors 222, 224 each delivers a signal to the control means 82 to cause actuation of the final control elements 78, 140 and therefore the brakes 74, 134 via the signal lines 80, 142. During braking, the shafts 50, 124 now move through the angular distances $\gamma$, $\delta$ until they stop. Thus, each shaft 50, 124 can be braked to a stop at a predetermined angular position of the shaft 50, 124.

The transmitters 234, 240 can serve as transmitters for observation of the predetermined final angular position and, in response to the same being exceeded, e.g. because of the brake lining of the corresponding brake having worn, trigger a warning via the control means 82 that the brake needs readjusting. Of course, the detectors 222, 224 can be, e.g. optical, in which event the transmitters (i.e. pick-offs or the like) 230, 232, 234 and 236, 238, 240 respectively, could take the form of dark areas on or perforations in the discs 218, 220.

The embodiment shown in FIG. 6 differs from the embodiment shown in FIG. 5 in that the rotating discs 218, 220 and associated pulse transmitters of FIG. 5 are replaced by angle-encoding discs 242, 244 which are disposed on and rotate with the shafts 50, 124. The discs 242, 244 have, for instance, arranged on a number of circles, opaque circle segments 246 (FIG. 6*a*) shown in the form of continuous lines and transparent circle segments 248 shown in the form of chain or dotted lines. In operation, the circle segments 246, 248 can be scanned by detecting means in the form of two scanning or detecting heads 252, 254 comprised, e.g. of a number of photodiodes 250. The elements 242, 252 and 244, 254 therefore form a respective encoder of the angular position of the respective shafts 50, 124. During one complete revolution of a shaft, for instance, 180 or 360 or 720 different electronic configurations are transmitted via multiple signal lines 226, 228 into a decoding section or part 256 of the control means 82. The encoders 242, 252 and 244, 254 thus emit an appropriate signal corresponding to the angular position of the respective shafts 50, 124 to make the angular position available electrically in the decoding part 256 and such position can be called up therefrom. When the current angular position on any of the discs 242, 244 coincides with an angular position stored in a store of the control means 82, the actuating element concerned may receive an actuating signal, with the possibility, for instance, of being able to preprogram various braking angle distances. A braking-condition monitor 260 is also connected via a signal line 258.

The brake system just described operates as follows:

If the two clutches 62, 65 are in the engaged state and the encoders 242, 252 and 244, 254 report the same value to the control means 82, the shafts 50, 124 are in the same angular position and are running synchronously. When a braking instruction arrives via one of the lines 85, the clutches 62, 125 disengage and the shafts 50, 124 are braked at a predetermined angular position which depends upon the preprogrammed braking angle. The actual final angular position as read by the encoders and a corresponding signal is placed in the store of the control means 82 and is taken into consideration at the next start of the machine or attachments or the like by the clutch of the lagging shaft being engaged first. When the two encoders 242, 252 and 244, 254 report the same value, a means within the control means 82 causes the second clutch to be actuated and thus the two shafts run synchronously again.

Different braking-angle distances, e.g. for "rapid stop" or "easy stop", can be stored in the control means, depending upon the origin of the detector signal. Consequently, the brake element concerned can be actuated at a different braking pressure in accordance with the detector signal if, for instance, the final control element 140 takes the form of a penumatic cylinder 140*a* (FIG. 6*b*). For example, as shown, the cylinder 140*a* has an air supply line 262 and an air discharge line 264, with the supply line 262 having an electrical pressure-controlling valve 266 therein which is connected to the signal line 142.

If a preset braking-angle distance is exceeded for any reason, for instance, because of a brake lining having worn, the braking condition detector 260 receives a corresponding signal and gives an e.g. optical indication that the corresponding brake needs adjusting.

In the practical operation of a brake system comprising two or more brakes, continuous monitoring of the braking distance is, with advantage, combined with automatic brake adjustment or brake control. Various set values for the braking-angle distances can be preprogrammed and compared continuously with the actual braking-angle distances with any difference between the set and the actual values acting on a braking controller or regulator. Advantageously too, the final angular positions of the shafts desirable for various causes of stoppages—i.e. for various detector signals—can be taken into consideration in braking, for the angular position, for instance, in the 360° region, at which a shaft comes to rest is often very important. Various final shaft angular positions can be preprogrammed and compared continuously with the instantaneous shaft angular position. If, for instance, a stop instruction is given, an easy stop or a rapid stop can be triggered depending on the difference between the instantaneous angular position and the required preprogrammed final angular position. An electronically controlled braking system of this kind based on the embodiment of FIG. 6 is shown diagrammatically in FIG. 7.

Referring to FIG. 7, wherein like reference characters indicate like parts as above, the clutches 62, 125 are connected via signal lines 268, 270 to a clutch/declutch unit 272, an angle comparator 274 and signal lines 276, 278 to the angle encoders 242, 252 and 244, 254. A brake-triggering unit 288 is connected via signal lines 280, 282 for rapid stoppage and easy stoppage respectively to the brake 74 and via corresponding signal lines 284, 286 to the brake 134. The unit 288 is also connected via signal lines 290, 292, 276 to the angle encoder 242, 252, via signal lines 294, 278 to the angle encoder 244, 254 and via signal line 296 to the clutch/declutch unit 272. Also, the braking-triggering unit 288 is connected via signal lines 298, 300, 302 to a stop selection unit 304 for the unit I (in this case a weaving machine) to be braked by the brake 74 and via signal lines 306, 308, 310 to a stop selection unit 312 for the unit II (in this case a jacquard attachment) to be braked by the brake 134. The stop selection units 304, 312 are connected to detector signal lines 314, 316, a separate line being associated with each cause of a stoppage. The detector signal lines 314, 316 are connected via a multiple line 318 to a final shaft angle preselector 320 which is connected via a signal line 322 to the unit 288.

Brake controllers or regulators 324, 326 associated with the brakes 74, 134 are connected via signal lines 328, 330 and 332, 324 for rapid stoppage and easy stoppage respectively to a braking-regulating unit 336 which is connected via signal lines 292 and 338, 278 to the angle encoders 242, 262 and 244, 254 respectively and via signal lines 340, 342 to the braking-triggering unit 288. A braking distance preselector 344 is connected via signal lines 346, 348 to the unit 336.

The system described operates as follows:

It will be assumed that the two units I, II are in engagement with the main drive and running normally, i.e. synchronously. A fault occurs in unit I and, via one of the lines 314, is fed as a fault signal to the stop selection unit 304 which decides on the basis of its preprogrammed data whether to output a rapid stop signal L via lines 300 or an easy stop signal M via line 302 to the braking-triggering unit 288. A rapid stop or easy stop of either unit should always trigger merely the easy stop of the other unit not directly concerned, although there are possible exceptions. If an easy stop is normally adequate or desired, the unit 288 receives the corresponding signal M via line 302 together with an identification signal R via line 298, the signal R indicating that the easy stop signal originates from unit I. The same procedure occurs in the event of a fault concerning unit II by way of the stop selection unit 312, the corresponding identification signal having the reference N.

However, before the braking-triggering unit 288 can output corresponding declutching and braking instructions, the unit 288 stores the instantaneous angle (or position) signal D received via signal lines 276, 292, 290—i.e. the angular value transmitted by the angle encoder 242, 252 at the time of the easy-stop signal M and compares the signal D with the final shaft angle signal I' called up via line 322 from the final shaft angle preselector 320. In other words, this comparison serves to determine whether the easy stop signal M can bring the unit I to a standstill before the necessary advantageous final shaft angle. The same comparison is carried out in respect of a signal M which is received from unit II via lines 308, 310. If the comparison is positive, the unit 288 transmits a signal A via line 296 to the clutch/declutch unit 272, which transmits corresponding declutch signals B, C via lines 268, 270 to clutches 62, 125. Immediately after release of the clutches, corresponding easy-stop braking signals H', J' are transmitted via lines 280, 286 to brakes 74, 134, and the units I, II are braked at their respective predetermined final angles.

If, however, the comparison of angular positions turns out to be negative—i.e. if e.g. the easy-stop signal M transmitted via line 302 would not bring the unit I to a standstill before the required final angle—the braking-triggering unit 288 can decide on a rapid stop instead of the originally intended easy stop and transmit, for instance, not the easy-stop signal H' via the signal line 280 but a rapid-stop signal H via the signal line 282 to the brake 74. Similar considerations apply to the brake 134.

After the two units I, II have come to a standstill, the unit 336 compares the instantaneous angle signal D or P (final angle) transmitted via the respective signal line 292 and 338 with the angle signal (initial angle) stored at the time of the braking instruction, and the latter signal is now called up as the signal E, Q respectively via the signal lines 340, 342 from the braking-triggering unit 288. The angular difference corresponding to the braking angle distance is compared with corresponding pre-stored values in the braking distance preselector 344 and the latter values are called up as signals U, U', T, T' via the lines 346, 348. If this comparison reveals a difference, such as the fact that the predetermined set value for braking distance has been exceeded, a corresponding brake adjusting signal F, F', G, G' is transmitted via one of the lines 328, 330, 332, 334 to one or both units 324, 326; the brake concerned is adjusted automatically so that the programmed braking distance is observed at the next brake application.

When it is required to restart the two units I, II, the same must run in angular synchronism with one another. If, for instance, unit I experienced a rapid stop while unit II experienced an easy stop, the unit II has a lead angle on the unit I. Through the agency of the angle signals D and P which are transmitted via the signal lines 276, 278 and the angle comparator 274, the clutch/declutch unit 272 ensures that when the units I and II are switched on, a clutching instruction initially reaches only the lagging unit—i.e. the unit I. The unit II engages only at the same angle signal D and P, having regard to the clutching operation. Of course, the same thing can occur but in the opposite sequence.

The brake elements can be any known brake elements such as drum brakes, band brakes and disc brakes. Electrical, magnetic or hydraulic brakes can be used.

What is claimed is:

1. In combination with a textile machine having a plurality of individual operating components and a main drive for actuating and driving each said component; a brake system including at least two brake elements, each said brake element being selectively connected to a respective component to effect braking thereof and each brake element having a different braking characteristic relative to the other of said brake elements, and a common control means for actuating said brake elements.

2. The combination as set forth in claim 1 wherein said braking characteristic is a start-to-brake time.

3. The combination as set forth in claim 1 wherein said braking characteristic is a braking distance.

4. The combination as set forth in claim 1 which further comprises a plurality of detecting means, each said detecting means being connected with a respective component and with said control means for activating a respective braking means.

5. The combination as set forth in claim 4 wherein each detecting means is selected from the group consisting of magnetic detectors, optical detectors, and rotatable discs having pulse transmitters thereon.

6. The combination as set forth in claim 4 wherein each detecting means includes a rotatable angle-encoding disc and a detecting head for sensing the angular position of said disc relative thereto.

7. The combination as set forth in claim 4 which further comprises an angle comparator connected to said detecting means for receiving and comparing said signals therefrom and a braking-triggering unit connected to said angle comparator to receive a signal therefrom in response to a predetermined difference between said signals received in said angle comparator.

8. The combination as set forth in claim 7 which further comprises stop selection units connected to said braking-triggering unit for emitting a selective braking signal thereto.

9. The combination as set forth in claim 8 which further comprises a multiple line connected to each stop selection unit and a shaft final angle preselector connected to and between said multiple line and said braking-triggering unit.

10. The combination as set forth in claim 7 wherein said braking-triggering unit includes means for storing a respective signal from said angle comparator.

11. The combination as set forth in claim 1 which further comprises a means for monitoring the operative state of each braking means.

12. The combination as set forth in claim 1 which further comprises a means for varying the operative state of each braking means.

13. The combination as set forth in claim 11 wherein said monitoring means is a braking control unit and which further comprises a plurality of detecting means, each said detecting means being connected with a respective component and with said control means for activating a respective braking means, an angle comparator connected to said detecting means for receiving and comparing said signals therefrom and a braking-triggering unit connected to said angle comparator to receive a signal therefrom in response to a predetermined difference between said signals received in said angle comparator.

14. The combination as set forth in claim 13 which further comprises a braking distance preselector connected to said braking control unit.

15. The combination as set forth in claim 13 wherein said braking-triggering unit includes a store for storing said signal from said angle comparator.

16. In combination with a textile machine having a plurality of individual operating components, a main drive shaft for driving at least one component and a second shaft driven off said main drive shaft for driving at least one other component;

a brake system including at least two brake elements, each said brake element being selectively connected to a respective shaft to effect braking thereof with each brake element having a different braking characteristic relative to the other of said brake elements, and a common control means for actuating said brake elements.

17. The combination as set forth in claim 16 which further comprises a plurality of detecting means, each said detecting means being operatively connected with a respective shaft and said control means to deliver a signal to said control means corresponding to the angular position of said respective shaft to cause actuation of said braking element associated with said respective shaft.

18. The combination as set forth in claim 17 wherein each detecting means is operatively connected with a respective shaft and said control means to deliver a signal to said control means corresponding to the stopped angular position of said respective shaft and said control means includes a store to receive each respective latter signal and means for subsequently restarting said shafts in dependence on said stored signals.

19. The combination as set forth in claim 17 wherein each detecting means includes a disc mounted on a respective shaft and a plurality of pulse transmitters mounted on said disc.

20. The combination as set forth in claim 17 wherein each detecting means includes an angle-encoding disc mounted on a respective shaft and a detecting head for scanning said disc.

21. An electronically controlled braking system for a textile machine having at least two commonly driven shafts for driving at least two components of said machine, said braking system including a first clutch for engaging one of said shafts;

a first angle encoder for determining the angular position of said one shaft and emitting a position signal in response thereto;

a first brake for engaging said one shaft;

a second clutch for engaging another of said shafts;

a second angle encoder for determining the angular position of said another shaft and emitting a position signal in response thereto;

a second brake for engaging said another shaft;

a first stop selection unit for emitting a stop signal in response to a detected fault in one of said components;

a second stop selection unit for emitting a stop signal in response to a detected fault in another of said components; and a braking trigger unit connected to said encoders to receive said position signals therefrom and to said stop selection units to receive said stop signals therefrom, said braking triggering unit being connected to each of said clutches to deliver an actuating signal thereto for release of a respective clutch from a respective shaft and to each of said brakes to deliver an actuating signal thereto in response to reception of a stop signal from a respective stop selection unit.

22. An electronically controlled braking system as set forth in claim 21 which further comprises a clutch/declutch unit connected to each of said angle encoders to receive said position signals therefrom, to said brake-triggering unit to receive said clutch actuating signal therefrom, and to each said clutch to actuate each clutch for disengagement from a respective shaft.

23. An electronically controlled braking system as set forth in claim 22 which further comprises a first shaft angle preselector connected in parallel with said stop selection units to store a final shaft angle signal therein, said preselector being connected to said brake-triggering unit to deliver said stored signal thereto for comparison with a received position signal from a respective encoder prior to emission of said clutch actuating signal to said clutch/declutch unit.

24. An electronically controlled braking system as set forth in claim 23 which comprises a first brake regulator connected to said first brake for adjusting the braking distance of said first brake; a second brake regulator connected to said second brake for adjusting the braking distance of said second brake; a braking-distance preselector for storing and emitting a signal corresponding to predetermined braking distance; a brake regulating unit connected to said encoders to receive said position signals, to said brake-triggering unit to receive an initial angle signal stored at the time of a braking instruction and to said braking distance preselector to receive said braking distance signal therefrom for comparison of a position signal with said initial angle signal and for emission of brake adjusting signal to a respective brake regulator in response to said comparison exceeding said braking distance signal.

25. A textile machine comprising a plurality of individual shaft-driven components;

a main drive for actuating and driving each said component;

a brake system including at least two brake elements, each said brake element being selectively connected to a respective component to effect braking thereof;

a plurality of detecting means, each said detecting means being connected with a respective component for sensing an angular position of said respective component and emitting a corresponding signal; and a common control means connected to said detecting means for actuating each respective brake element in response to a signal from a respective detecting means to stop said respective component at a predetermined angular position thereof.

26. A textile machine comprising a plurality of individual operating components;

a first shaft for driving at least one component;

a second shaft for driving at least one other component;

a brake system including at least two brake elements, each said brake element being selectively connected to a respective shaft to effect braking thereof;

a common control means for actuating said brake elements; and a plurality of detecting means, each said detecting means being operatively connected with a respective shaft for sensing an angular position of said respective shaft and being connected with said control means to deliver a signal to said control means corresponding to said angular position of said respective shaft to cause actuation of said braking element associated with said respective shaft whereby said control means brakes each shaft to a stop at a predetermined angular position thereof.

* * * * *